US007863229B2

(12) United States Patent
Poirier et al.

(10) Patent No.: US 7,863,229 B2
(45) Date of Patent: Jan. 4, 2011

(54) LUBRICATING COMPOSITIONS

(75) Inventors: Marc-Andre Poirier, Sarnia (CA); Douglas E. Deckman, Mullica Hill, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 328 days.

(21) Appl. No.: 11/809,456

(22) Filed: Jun. 1, 2007

(65) Prior Publication Data

US 2007/0298987 A1 Dec. 27, 2007

Related U.S. Application Data

(60) Provisional application No. 60/816,134, filed on Jun. 23, 2006.

(51) Int. Cl.
*C10M 129/74* (2006.01)
*C10M 129/95* (2006.01)
*C10M 129/04* (2006.01)

(52) U.S. Cl. ..... 508/485; 508/486; 208/18; 208/950; 208/97

(58) Field of Classification Search ..... 524/447; 508/454, 485, 486; 208/18, 950, 97
See application file for complete search history.

(56) References Cited

U.S. PATENT DOCUMENTS 4,645,615 A 2/1987 Drake
4,801,390 A 1/1989 Robson
6,303,547 B1 * 10/2001 Balasubramaniam ..... 508/454
2005/0148477 A1 7/2005 Friend et al.
2005/0261147 A1 11/2005 Rosenbaum et al.
2006/0052256 A1 3/2006 Barnes et al.
2006/0189744 A1 * 8/2006 Tse et al. ..... 524/447
2006/0276354 A1 * 12/2006 Donaghy et al. ..... 508/485

FOREIGN PATENT DOCUMENTS

WO WO 01/57166 A1 8/2001
WO WO2004053030 * 6/2004

* cited by examiner

*Primary Examiner*—Michael A Marcheschi
*Assistant Examiner*—Chantel Graham

(57) ABSTRACT

The pour point of a lubricating composition consisting essentially of from about 5 wt % to about 100 wt % of a Group III base stock and from 0 wt % to about 95 wt % of a Group IV base stock is reduced by incorporating in the lubricating composition an effective amount of a polyol ester represented by Formula I

I

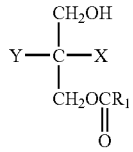

wherein x=OH or $CH_2OH$; y=H, $CH_3$, $CH_3CH_2$, or $CH_2OH$; and $R_1$ is an aliphatic hydrocarbyl group having from about 16 to about 30 carbon atoms.

3 Claims, No Drawings

LUBRICATING COMPOSITIONS

This application claims priority of Provisional Application 60/816,134 filed Jun. 23, 2006.

FIELD OF THE INVENTION

The present invention relates generally to lubricating compositions. More particularly, the invention relates to reducing the pour point of lubricating compositions, especially compositions for use in automotive and industrial applications that utilize as the base oil highly paraffinic oils derived from waxy feeds.

BACKGROUND OF THE INVENTION

Finished high performance and industrial lubricants consist of two main components. The first and major component is the lubricating base oil. The second is the performance enhancing additives. The additive component is required to assure that the finished composition meets specifications set by government agencies, equipment manufacturers and other organizations. For example, many commercial lubricating compositions have specifications for pour point which is a measure of the temperature at which a sample of the lubricating composition will begin to flow under carefully controlled test conditions such as specified by the American Society for Testing Materials (ASTM).

Pour point depressants are additives known in the art and typically include polymethacrylates, polyacrylates, polyacrylamides, vinylcarboxylate polymers, terpolymers of dialkylfumarates, vinyl esters of fatty acids and ethylene-vinyl acetate copolymers to mention a few. Because of their polymeric nature, these pour point depressants are subject to shearing during their use, thereby impacting the useful life of the lubricating compositions containing them.

Experience has taught that the overall effect of additives may depend not only on the nature and concentration of the additives, but also on the nature of the oil as well. The invention disclosed herein lends support to the observation that the base oil of a lubricant formulation may have an influence on additive performance, especially on pour point depressant performance.

SUMMARY OF THE INVENTION

In one embodiment of the invention, there is provided a lubricating composition comprising a major amount of a lubricating base oil consisting essentially of from about 5 wt % to about 100 wt % of a Group III base stock and from 0 wt % to about 95 wt % of a Group IV base stock, the percentages being based on the total weight of the base oil, and an effective amount of a pour point depressant consisting of a polyol ester represented by the Formula I

I

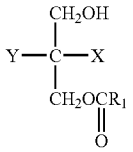

wherein x=OH or $CH_2OH$; y=H, $CH_3$, $CH_3CH_2$, or $CH_2OH$; and $R_1$ is an aliphatic hydrocarbyl group having from about 16 to about 30 carbon atoms.

In another embodiment, there is provided a method for reducing the pour point of a base oil consisting essentially of from about 5 wt % to about 100 wt % of a Group III base stock and from 0 wt % to about 95 wt % of a Group IV base stock, the percentages being based on the total weight of the base oil, by incorporating in the base oil an effective amount of a pour point depressant consisting of a polyol ester represented by Formula I

I

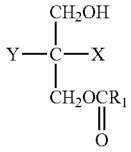

wherein x=OH or $CH_2OH$; y=H, $CH_3$, $CH_3CH_2$, or $CH_2OH$; and $R_1$ is an aliphatic hydrocarbyl group having from about 16 to about 30 carbon atoms.

DETAILED DESCRIPTION OF THE INVENTION

The lubricating oil compositions of the invention comprise a major amount of a lubricating base oil which consists essentially of a Group III base stock and optionally up to about 95 wt % of a Group IV base stock. Thus, based on the total weight of the base oil, the base oil will contain from about 5 wt % to 100 wt % of a Group III base stock and from 0 wt % to about 95 wt % of a Group IV base stock.

Groups I, II, III, IV and V are broad categories of base stocks defined by the American Petroleum Institute (API Publication 1509; www.API.org) to create guidelines for lubricant base oils. Table A summarizes properties of each of these five groups.

TABLE A

| Base Stock Properties | | | |
|---|---|---|---|
| | Saturates | Sulfur | Viscosity Index |
| Group I | <90 wt % and/or | >0.03 wt % and | ≧80 and <120 |
| Group II | ≧90 wt % and | ≦0.03 wt % and | ≧80 and <120 |
| Group III | ≧90 wt % and | ≦0.03 wt % and | ≧120 |
| Group IV | Polyalphaolefins (PAO) | | |
| Group V | All other base stocks not included in Groups I, II, III, or IV | | |

In the present invention, the base oil preferably is 100 wt % of a Group III base stock, especially a base stock obtained by hydroisomerization or isodewaxing of a highly paraffinic wax such as a Fischer-Tropsch wax or a slack wax. Indeed, Group III base stocks derived from gases, i.e., gas to liquid (GTL) base stocks, are most preferred.

As used herein, the following terms have the indicated meanings:

(a) "wax": hydrocarbonaceous material having a high pour point, typically existing as a solid at room temperature, i.e., at a temperature in the range from about 15° C. to 25° C., and consisting predominantly of paraffinic materials;

(b) "paraffinic" material: any saturated hydrocarbons, such as alkanes. Paraffinic materials typically consist essentially of linear alkanes and slightly branched alkanes (iso-paraffins), but may also include some cycloalkanes (cycloparaffins; mono-ring and/or multi-ring), and branched cycloalkanes;

(c) "hydroprocessing": a refining process in which a feedstock is heated with hydrogen at high temperature and under pressure, commonly in the presence of a catalyst, to remove and/or convert less desirable components and to produce an improved product;

(d) "hydrotreating": a catalytic hydrogenation process that converts sulfur- and/or nitrogen-containing hydrocarbons into hydrocarbon products with reduced sulfur and/or nitrogen content, and which generates hydrogen sulfide and/or ammonia (respectively) as byproducts; similarly, oxygen containing hydrocarbons can also be reduced to hydrocarbons and water;

(e) "hydrodewaxing" (or catalytic dewaxing): a catalytic process in which normal paraffins (wax) and/or waxy hydrocarbons are converted by cracking/fragmentation into lower molecular weight species, and by rearrangement/isomerization into more branched iso-paraffins;

(f) "hydroisomerization" (or isomerization or isodewaxing): a catalytic process in which normal paraffins (wax) and/or slightly branched iso-paraffins are converted by rearrangement/isomerization into more branched iso-paraffins; the products of such process are also referred to as "hydroisomerates" or "isodewaxates";

(g) "hydrocracking": a catalytic process in which hydrogenation accompanies the cracking/fragmentation of hydrocarbons, e.g., converting heavier hydrocarbons into lighter hydrocarbons, or converting aromatics and/or cycloparaffins (naphthenes) into non-cyclic branched paraffins.

(h) "solvent dewaxing": a process in which the wax component of a hydrocarbon mixture is removed by contacting the hydrocarbon mixture with a solvent;

(i) the term "hydroisomerization/hydrodewaxing" is used to refer to one or more catalytic processes which have the combined effect of hydroisomerizing and hydrodewaxing.

GTL materials are materials that are derived via one or more synthesis, combination, transformation, rearrangement, and/or degradation/deconstructive processes from gaseous carbon-containing compounds, hydrogen-containing compounds, and/or elements as feedstocks such as hydrogen, carbon dioxide, carbon monoxide, water, methane, ethane, ethylene, acetylene, propane, propylene, propyne, butane, butylenes, and butynes. GTL base stocks and base oils are GTL materials of lubricating viscosity that are generally derived from waxy synthesized hydrocarbons. GTL base stock(s) include base stocks derived from GTL materials, obtained by a Fisher-Tropsch (F-T) process, and hereinafter referred to as F-T materials.

GTL base stock(s), especially isodewaxed F-T material-derived base stock(s), typically have kinematic viscosities at 100° C. of from about 2 $mm^2/s$ to about 50 $mm^2/s$, preferably from about 3 $mm^2/s$ to about 50 $mm^2/s$, more preferably from about 3.5 $mm^2/s$ to about 30 $mm^2/s$. Reference herein to kinematic viscosity refers to a measurement made by ASTM method D445.

GTL base stocks and base oils derived from GTL materials, especially isodewaxed F-T material derived base stock(s), and other isodewaxed wax-derived base stock(s), such as wax isodewaxates, which can be used as base stock components of this invention are further characterized typically as having pour points of about −5° C. or lower, preferably about −10° C. or lower, more preferably about −15° C. or lower, still more preferably about −20° C. or lower, and under some conditions may have advantageous pour points of about −25° C. or lower, with useful pour points of about −30° C. to about −40° C. or lower. If necessary, a separate dewaxing step may be practiced to achieve the desired pour point. References herein to pour point refer to measurement made by ASTM D97 and similar automated versions.

The GTL base stock(s) derived from GTL materials, especially isodewaxed F-T material derived base stock(s), and other isodewaxed wax-derived base stock(s) which are base stock components which can be used in this invention are also characterized typically as having viscosity indices of 120 or greater in certain particular instances, viscosity index of these base stocks may be preferably 130 or greater, more preferably 135 or greater, and even more preferably 140 or greater. For example, GTL base stock(s) that derive from GTL materials preferably F-T materials especially F-T wax generally have a viscosity index of 130 or greater. References herein to viscosity index refer to ASTM method D2270.

A non limiting example of a GTL base stock is a GTL base stock derived by the isodewaxing of F-T wax, said GTL base stock having a kinematic viscosity of about 4 $mm^2/s$ at 100° C. and a viscosity index of about 130 or greater.

In addition, the GTL base stock(s) are typically highly paraffinic (>90% saturates), and may contain mixtures of monocycloparaffins and multicyclo-paraffins in combination with non-cyclic isoparaffins. The ratio of the naphthenic (i.e., cycloparaffin) content in such combinations varies with the catalyst and temperature used. Further, GTL base stocks and GTL base oils typically have very low sulfur and nitrogen content, generally containing less than about 10 ppm, and more typically less than about 5 ppm of each of these elements. The sulfur and nitrogen content of GTL base stock and GTL base oil obtained by the isodewaxing of F-T material, especially F-T wax is essentially nil.

In a preferred embodiment, the GTL base stock(s) comprise(s) paraffinic materials that consist predominantly of non-cyclic isoparaffins and only minor amounts of cycloparaffins. These GTL base stock(s) typically comprise paraffinic materials that consist of greater than 60 wt % non-cyclic isoparaffins, preferably greater than 80 wt % non-cyclic isoparaffins, more preferably greater than 85 wt % non-cyclic isoparaffins, and most preferably greater than 90 wt % non-cyclic isoparaffins.

Useful compositions of GTL base stock(s), isodewaxed F-T material derived base stock(s), and wax-derived isodewaxed base stock(s), such as wax isodewaxates, are recited in U.S. Pat. Nos. 6,080,301; 6,090,989, and 6,165,949 for example.

Isodewaxate base stock(s), derived from waxy feeds, which are also suitable for use in this invention, are paraffinic fluids of lubricating viscosity derived from isodewaxed waxy feedstocks of mineral oil, non-mineral oil, non-petroleum, or natural source origin, e.g., feedstocks such as one or more of gas oils, slack wax, waxy fuels hydrocracker bottoms, hydrocarbon raffinates, natural waxes, hyrocrackates, thermal crackates, foots oil, wax from coal liquefaction or from shale oil, or other suitable mineral oil, non-mineral oil, non-petroleum, or natural source derived waxy materials, linear or branched hydrocarbyl compounds with carbon number of about 20 or greater, preferably about 30 or greater, and mixtures of such isodewaxate base stocks and base oils.

Slack wax is the wax recovered from petroleum oils by solvent or autorefrigerative dewaxing. Solvent dewaxing employs chilled solvent such as methyl ethyl ketone (MEK), methyl isobutyl ketone (MIBK), mixtures of MEK/MIBK, mixtures of MEK and toluene, while autorefrigerative dewaxing employs pressurized, liquefied low boiling hydrocarbons such as propane or butane.

Slack wax(es), being secured from petroleum oils, may contain sulfur and nitrogen containing compounds. Such heteroatom compounds must be removed by hydrotreating (and not hydrocracking), as for example by hydrode-sulfurization (HDS) and hydrodenitrogenation (HDN) so as to avoid subsequent poisoning/deactivation of the hydroisomerization catalyst.

The term base oil as used herein and in the claims refers to the oil components of the lubricating composition, that is the oil composition, excluding the additives with which the base oil is to be formulated. A base oil may consist of one or several base stocks.

The term GTL base stock and/or wax isomerate base stock as used herein and in the claims is to be understood as embracing individual fractions of GTL base stock or wax isomerate base stock as recovered in the production process, mixtures of two or more GTL base stocks and/or wax isomerate base stocks, as well as mixtures of one or two or more low viscosity GTL base stock(s) and/or wax isomerate base stock(s) with one, two or more high viscosity GTL base stock(s) and/or wax isomerate base stock(s) to produce a blend, often referred to in the art as a dumbbell blend, exhibiting a viscosity within the aforesaid recited range.

In a preferred embodiment, the GTL material, from which the GTL base stock(s) is/are derived, is an F-T material (i.e., hydrocarbons, waxy hydro-carbons, wax). A slurry F-T synthesis process may be beneficially used for synthesizing the F-T material from CO and hydrogen and particularly one employing an F-T catalyst comprising a catalytic cobalt component to provide a high alpha for producing the more desirable higher molecular weight paraffins. This process is also well known to those skilled in the art.

In an F-T synthesis process, a synthesis gas comprising a mixture of $H_2$ and CO is catalytically converted into hydrocarbons and preferably liquid hydrocarbons. The mole ratio of the hydrogen to the carbon monoxide may broadly range from about 0.5 to 4, but which is more typically within the range of from about 0.7 to 2.75 and preferably from about 0.7 to 2.5. As is well known, F-T synthesis processes include processes in which the catalyst is in the form of a fixed bed, a fluidized bed or as a slurry of catalyst particles in a hydrocarbon slurry liquid. The stoichiometric mole ratio for an F-T synthesis reaction is 2.0, but there are many reasons for using other than a stoichiometric ratio as those skilled in the art know. In cobalt slurry hydrocarbon synthesis process the feed mole ratio of the $H_2$ to CO is typically about 2.1/1. The synthesis gas comprising a mixture of $H_2$ and CO is bubbled up into the bottom of the slurry and reacts in the presence of the particulate F-T synthesis catalyst in the slurry liquid at conditions effective to form hydrocarbons, a portion of which are liquid at the reaction conditions and which comprise the hydrocarbon slurry liquid. The synthesized hydrocarbon liquid is separated from the catalyst particles as filtrate by means such as filtration, although other separation means such as centrifugation can be used. Some of the synthesized hydrocarbons pass out the top of the hydrocarbon synthesis reactor as vapor, along with unreacted synthesis gas and other gaseous reaction products. Some of these overhead hydrocarbon vapors are typically condensed to liquid and combined with the hydrocarbon liquid filtrate. Thus, the initial boiling point of the filtrate may vary depending on whether or not some of the condensed hydrocarbon vapors have been combined with it. Slurry hydrocarbon synthesis process conditions vary somewhat depending on the catalyst and desired products. Typical conditions effective to form hydrocarbons comprising mostly $C_{5+}$ paraffins, (e.g., $C_{5+}$-$C_{200}$) and preferably $C_{10+}$ paraffins, in a slurry hydrocarbon synthesis process employing a catalyst comprising a supported cobalt component include, for example, temperatures, pressures and hourly gas space velocities in the range of from about 320-850° F., 80-600 psi and 100-40,000 V/hr/V, expressed as standard volumes of the gaseous CO and $H_2$ mixture (0° C., 1 atm) per hour per volume of catalyst, respectively. The term "$C_{5+}$" is used herein to refer to hydrocarbons with a carbon number of greater than 4, but does not imply that material with carbon number 5 has to be present. Similarly other ranges quoted for carbon number do not imply that hydrocarbons having the limit values of the carbon number range have to be present, or that every carbon number in the quoted range is present. It is preferred that the hydrocarbon synthesis reaction be conducted under conditions in which limited or no water gas shift reaction occurs and more preferably with no water gas shift reaction occurring during the hydrocarbon synthesis. It is also preferred to conduct the reaction under conditions to achieve an alpha of at least 0.85, preferably at least 0.9 and more preferably at least 0.92, so as to synthesize more of the more desirable higher molecular weight hydrocarbons. This has been achieved in a slurry process using a catalyst containing a catalytic cobalt component. Those skilled in the art know that by alpha is meant the Schultz-Flory kinetic alpha. While suitable F-T reaction types of catalyst comprise, for example, one or more Group VIII catalytic metals such as Fe, Ni, Co, Ru and Re, it is preferred that the catalyst comprise a cobalt catalytic component. In one embodiment the catalyst comprises catalytically effective amounts of Co and one or more of Re, Ru, Fe, Ni, Th, Zr, Hf, U, Mg and La on a suitable inorganic support material, preferably one which comprises one or more refractory metal oxides. Preferred supports for Co containing catalysts comprise Titania, particularly. Useful catalysts and their preparation are known and illustrative, but nonlimiting examples may be found, for example, in U.S. Pat. Nos. 4,568,663; 4,663,305; 4,542,122; 4,621,072 and 5,545,674.

As set forth above, the waxy feed from which the base stock(s) is/are derived may also be a wax or waxy feed from mineral oil, non-mineral oil, non-petroleum, or other natural source, especially slack wax, or GTL material, preferably F-T material, referred to as F-T wax. F-T wax preferably has an initial boiling point in the range of from 650-750° F. and preferably continuously boils up to an end point of at least 1050° F. A narrower cut waxy feed may also be used during the isodewaxing. A portion of the n-paraffin waxy feed is converted to lower boiling isoparaffinic material. Hence, there must be sufficient heavy n-paraffin material to yield an isoparaffin containing isodewaxate boiling in the lube oil range. If catalytic dewaxing is also practiced after isodewaxing, some of the isodewaxate will also be hydrocracked to lower boiling material during the conventional catalytic dewaxing. Hence, it is preferred that the end boiling point of the waxy feed be above 1050° F. (1050° F.+).

When a boiling range is quoted herein it defines the lower and/or upper distillation temperature used to separate the fraction. Unless specifically stated (for example, by specifying that the fraction boils continuously or constitutes the entire range) the specification of a boiling range does not require any material at the specified limit has to be present, rather it excludes material boiling outside that range.

The waxy feed from which the base stocks are derived preferably comprises the entire 650-750° F.+ fraction formed by the hydrocarbon synthesis process, having an initial cut point between 650° F. and 750° F. determined by the practitioner and an end point, preferably above 1050° F., determined by the catalyst and process variables employed by the practitioner for the synthesis. Such fractions are referred to herein as "650-750° F.+ fractions". By contrast, "650-750° F.⁻ fractions" refers to a fraction with an unspecified initial cut point and an end point somewhere between 650° F. and 750° F. Waxy feeds may be processed as the entire fraction or as subsets of the entire fraction prepared by distillation or other separation techniques. The waxy feed also typically comprises more than 90%, generally more than 95% and preferably more than 98 wt % paraffinic hydrocarbons, most of which are normal paraffins. It has negligible amounts of sulfur and nitrogen compounds (e.g., less than 1 wppm of each), with less than 2,000 wppm, preferably less than 1,000 wppm and more preferably less than 500 wppm of oxygen, in the form of oxygenates. Waxy feeds having these properties and useful in the process of the invention have been made using a slurry F-T process with a catalyst having a catalytic cobalt component, as previously indicated.

The process of making the lubricant oil base stocks from waxy stocks, e.g., slack wax or F-T wax, may be characterized as a hydrodewaxing process. If slack waxes are used as the feed, they may need to be subjected to a preliminary hydrotreating step under conditions already well known to those skilled in the art to reduce (to levels that would effectively avoid catalyst poisoning or deactivation) or to remove sulfur- and nitrogen-containing compounds which would otherwise deactivate the hydroisomerization/hydrodewaxing catalyst used in subsequent steps. If F-T waxes are used, such preliminary treatment is not required because, as indicated above, such waxes have only trace amounts (less than about 10 ppm, or more typically less than about 5 ppm to nil) of sulfur or nitrogen compound content. However, some hydrodewaxing catalyst fed F-T waxes may benefit from removal of oxygenates while others may benefit from oxygenates treatment. The hydrodewaxing process may be conducted over a combination of catalysts, or over a single catalyst. Conversion temperatures range from about 150° C. to about 500° C. at pressures ranging from about 500 to 20,000 kPa. This process may be operated in the presence of hydrogen, and hydrogen partial pressures range from about 600 to 6000 kPa. The ratio of hydrogen to the hydrocarbon feedstock (hydrogen circulation rate) typically range from about 10 to 3500 $n.l.l.^{-1}$ (56 to 19,660 SCF/bbl) and the space velocity of the feedstock typically ranges from about 0.1 to 20 LHSV, preferably 0.1 to 10 LHSV.

Following any needed hydrodenitrogenation or hydrodesulfurization, the hydroprocessing used for the production of base stocks from such waxy feeds may use an amorphous hydrocracking/hydroisomerization catalyst, such as a lube hydrocracking (LHDC) catalysts, for example catalysts containing Co, Mo, Ni, W, Mo, etc., on oxide supports, e.g., alumina, silica, silica/alumina, or a crystalline hydrocracking/hydroisomerization catalyst, preferably a zeolitic catalyst.

Other isomerization catalysts and processes for hydrocracking/hydroisomerizing/isodewaxing GTL materials and/or waxy materials to base stock or base oil are described, for example, in U.S. Pat. Nos. 2,817,693; 4,900,407; 4,937,399; 4,975,177; 4,921,594; 5,200,382; 5,516,740; 5,182,248; 5,290,426; 5,580,442; 5,976,351; 5,935,417; 5,885,438; 5,965,475; 6,190,532; 6,375,830; 6,332,974; 6,103,099; 6,025,305; 6,080,301; 6,096,940; 6,620,312; 6,676,827; 6,383,366; 6,475,960; 5,059,299; 5,977,425; 5,935,416; 4,923,588; 5,158,671; and 4,897,178; EP 0324528 (B1), EP 0532116 (B1), EP 0532118 (B1), EP 0537815 (B1), EP 0583836 (B2), EP 0666894 (B2), EP 0668342 (B1), EP 0776959 (A3), WO 97/031693 (A1), WO 02/064710 (A2), WO 02/064711 (A1), WO 02/070627 (A2), WO 02/070629 (A1), WO 03/033320 (A1) as well as in British Patents 1,429,494; 1,350,257; 1,440,230; 1,390,359; WO 99/45085 and WO 99/20720. Particularly favorable processes are described in European Patent Applications 464546 and 464547. Processes using F-T wax feeds are described in U.S. Pat. Nos. 4,594,172; 4,943,672; 6,046,940; 6,475,960; 6,103,099; 6,332,974; and 6,375,830.

Hydrocarbon conversion catalysts useful to hydroisomerize waxy feedstocks are zeolite catalysts, such as ZSM-5, ZSM-11, ZSM-23, ZSM-35, ZSM-12, ZSM-38, ZSM-48, offretite, ferrierite, zeolite beta, zeolite theta, and zeolite alpha, as disclosed in U.S. Pat. No. 4,906,350. These catalysts are used in combination with Group VIII metals, in particular palladium or platinum. The Group VIII metals may be incorporated into the zeolite catalysts by conventional techniques, such as ion exchange. In one embodiment, conversion of the waxy feedstock may be conducted over a combination of Pt/zeolite beta and Pt/ZSM-23 catalysts in the presence of hydrogen.

In another embodiment, hydroisomerization/hydrodewaxing is carried out over a single catalyst, such as Pt/ZSM-35. In yet another embodiment, the waxy feed can be fed over Group VIII metal loaded ZSM-48, preferably Group VIII noble metal loaded ZSM-48, more preferably Pt/ZSM-48 in either one stage two stages. In any case, useful hydrocarbon base oil products may be obtained. Catalyst ZSM-48 is described in U.S. Pat. No. 5,075,269. The use of the Group VIII metal loaded ZSM-48 family of catalysts, preferably platinum on ZSM-48, in the hydroisomerization of the waxy feedstock eliminates the need for any subsequent, separate dewaxing step, and is preferred.

A separate dewaxing step, when needed, may be accomplished using either well known solvent or catalytic dewaxing processes and either the entire hydroisomerate or the 650-750° F.+ fraction may be dewaxed, depending on the intended use of the 650-750° F.− material present, if it has not been separated from the higher boiling material prior to the dewaxing. In solvent dewaxing, the hydroisomerate may be contacted with chilled solvents such as acetone, methyl ethyl ketone (MEK), methyl isobutyl ketone (MIBK), mixtures of MEK/MIBK, or mixtures of MEK/toluene and the like, and further chilled to precipitate out the higher pour point material as a waxy solid which is then separated from the solvent-containing lube oil fraction which is the raffinate. The raffinate is typically further chilled in scraped surface chillers to remove more wax solids. Low molecular weight hydrocarbons, such as propane, are also used for dewaxing, in which the hydroisomerate is mixed with liquid propane, a least a portion of which is flashed off to chill down the hydroisomerate to precipitate out the wax. The wax is separated from the raffinate by filtration, membrane separation or centrifugation. The solvent is then stripped out of the raffinate, which is then fractionated to produce the preferred base stocks useful in the present invention. Also well known is catalytic dewaxing, in which the hydroisomerate is reacted with hydrogen in the presence of a suitable dewaxing catalyst at conditions effective to lower the pour point of the hydroisomerate. Catalytic dewaxing also converts a portion of the hydroisomerate to lower boiling materials, in the boiling range, for example, 650-750° F.−, which are separated from the heavier 650-750° F.+ base stock fraction and the base stock fraction fractionated into two more base stocks. Separation of the lower boiling material may be accomplished either prior to or during fractionation of the 650-750° F.+ material into the desired base stocks.

Any dewaxing catalyst which will reduce the pour point of the hydro-isomerate and preferably those which provide a large yield of lube oil base stock from the hydroisomerate may be used. These include shape selective molecular sieves which, when combined with at least one catalytic metal component, have been demonstrated as useful for dewaxing petroleum oil fractions and include, for example, ferrierite, mordenite, ZSM-5, ZSM-11, ZSM-23, ZSM-35, ZSM-22 also known as theta one or TON, and the silicoaluminophosphates known as SAPO's. A dewaxing catalyst which has been found to be unexpectedly particularly effective comprises a noble metal, preferably Pt, composited with H-mordenite. The dewaxing may be accomplished with the catalyst in a fixed, fluid or slurry bed. Typical dewaxing conditions include a temperature in the range of from about 400-600° F., a pressure of 500-900 psig, $H_2$ treat rate of 1500-3500 SCF/B for flow-through reactors and LHSV of 0.1-10, preferably 0.2-2.0. The dewaxing is typically conducted to convert no more than 40 wt % and preferably no more than 30 wt % of the hydroisomerate having an initial boiling point in the range of 650-750° F. to material boiling below its initial boiling point.

GTL base stock(s), and isodewaxed wax-derived base stock(s), have a beneficial kinematic viscosity advantage over conventional Group II and Group III base stocks and base oils, and so may be very advantageously used with the instant invention. Such GTL base stocks have kinematic viscosities up to about 20-50 $mm^2/s$ at 100° C., whereas by comparison commercial Group II base oils can have kinematic viscosities, up to about 15 $mm^2/s$ at 100° C., and commercial Group III base oils can have kinematic viscosities, up to about 10 $mm^2/s$ at 100° C. The higher kinematic viscosity range of GTL base stocks, compared to the more limited kinematic viscosity range of conventional Group II and Group III base stocks can provide additional beneficial advantages in formulating lubricant compositions according to the present invention.

In the present invention the one or more isodewaxate base stock(s), the GTL base stock(s), or mixtures thereof, preferably GTL base stock(s) can constitute all or part of the base oil.

One or more of the wax isodewaxate base stocks can be used as such or in combination with the GTL base stock(s).

One or more of these waxy feed derived base stocks, derived from GTL materials and/or other waxy feed materials can similarly be used as such or further in combination with other base stocks of mineral oil origin, natural oils and/or with synthetic base oils.

The preferred base stocks derived from GTL materials and/or from waxy feeds are characterized as having predominantly paraffinic compositions and are further characterized as having high saturates levels, low-to-nil sulfur, low-to-nil nitrogen, low-to-nil aromatics, and are essentially water-white in color.

The lubricating composition of the invention comprises a major amount of lubricating base oil, the lubricating base oil being obtained from one or several base stocks. Typically, the lubricating composition contains from 50 to 99.95 wt %, preferably from 60 to 99.95 wt %, conveniently from 75 to 99.95 wt % base oil, the balance being used by the practitioner for additives, to suit the requirements of the finished lubricant.

The GTL base stock and/or wax isodewaxate, preferably GTL base stocks obtained from F-T wax, more preferably GTL base stocks obtained by the isodewaxing of F-T wax, can constitute from 5 to 100 wt %, preferably 40 to 100 wt %, more preferably 70 to 100 wt % by weight of the total of the base oil, the amount employed being left to the practitioner in response to the requirements of the finished lubricant.

A preferred GTL liquid hydrocarbon composition used as base stock is one comprising paraffinic hydrocarbon components in which the extent of branching, as measured by the percentage of methyl hydrogens (BI), and the proximity of branching, as measured by the percentage of recurring methylene carbons which are four or more carbons removed from an end group or branch ($CH_2 \geqq 4$), are such that: (a) $BI-0.5(CH_2 \geqq 4)>15$; and (b) $BI+0.85(CH_2 \geqq 4)<45$ as measured over said liquid hydrocarbon composition as a whole.

The preferred GTL base stock can be further characterized, if necessary, as having less than 0.1 wt % aromatic hydrocarbons, less than 20 wppm nitrogen containing compounds, less than 20 wppm sulfur containing compounds, a pour point of less than −18° C., preferably less than −30° C., a preferred $BI \geqq 25.4$ and $(CH_2 \geqq 4) \leqq 22.5$. They have a nominal boiling point of 370° C.$^+$, on average they average fewer than 10 hexyl or longer branches per 100 carbon atoms and on average have more than 16 methyl branches per 100 carbon atoms. They also can be characterized by a combination of dynamic viscosity, as measured by CCS at −40° C., and kinematic viscosity, as measured at 100° C. represented by the formula:

$$DV\ (\text{at } -40^\circ\ C.) < 2900\ (KV@100^\circ\ C.) - 7000.$$

The preferred GTL base stock is also characterized as comprising a mixture of branched paraffins characterized in that the base stock contains at least 90% of a mixture of branched paraffins, wherein said branched paraffins are paraffins having a carbon chain length of about $C_{20}$ to about $C_{40}$, a molecular weight of about 280 to about 562, a boiling range of about 650° F. to about 1050° F., and wherein said branched paraffins contain up to four alkyl branches and wherein the free carbon index of said branched paraffins is at least about 3.

In the above the Branching Index (BI), Branching Proximity ($CH_2 \geqq 4$), and Free Carbon Index (FCI) are determined as follows:

Branching Index

A 359.88 MHz 1H solution NMR spectrum is obtained on a Bruker 360 MHz AMX spectrometer using 10% solutions in $CDCl_3$. TMS is the internal chemical shift reference. $CDCl_3$ solvent gives a peak located at 7.28. All spectra are obtained under quantitative conditions using 90 degree pulse (10.9 μs), a pulse delay time of 30 s, which is at least five times the longest hydrogen spin-lattice relaxation time ($T_1$), and 120 scans to ensure good signal-to-noise ratios.

H atom types are defined according to the following regions:

9.2-6.2 ppm hydrogens on aromatic rings;

6.2-4.0 ppm hydrogens on olefinic carbon atoms;

4.0-2.1 ppm benzylic hydrogens at the α-position to aromatic rings;

2.1-1.4 ppm paraffinic CH methine hydrogens;

1.4-1.05 ppm paraffinic $CH_2$ methylene hydrogens;

1.05-0.5 ppm paraffinic $CH_3$ methyl hydrogens.

The branching index (BI) is calculated as the ratio in percent of non-benzylic methyl hydrogens in the range of 0.5 to 1.05 ppm, to the total non-benzylic aliphatic hydrogens in the range of 0.5 to 2.1 ppm.

Branching Proximity ($CH_2 \geqq 4$)

A 90.5 MHz$^3$CMR single pulse and 135 Distortionless Enhancement by Polarization Transfer (DEPT) NMR spectra are obtained on a Brucker 360 MHzAMX spectrometer using 10% solutions in $CDCl_3$. TMS is the internal chemical shift reference. $CDCl_3$ solvent gives a triplet located at 77.23 ppm in the $^{13}C$ spectrum. All single pulse spectra are obtained under quantitative conditions using 45 degree pulses (6.3 μs), a pulse delay time of 60 s, which is at least five times the longest carbon spin-lattice relaxation time ($T_1$), to ensure complete relaxation of the sample, 200 scans to ensure good signal-to-noise ratios, and WALTZ-16 proton decoupling.

The C atom types $CH_3$, $CH_2$, and CH are identified from the 135 DEPT $^{13}C$ NMR experiment. A major $CH_2$ resonance in all $^{13}C$ NMR spectra at ≈29.8 ppm is due to equivalent recurring methylene carbons which are four or more removed from an end group or branch ($CH_2$>4). The types of branches are determined based primarily on the $^{13}C$ chemical shifts for the methyl carbon at the end of the branch or the methylene carbon one removed from the methyl on the branch.

Free Carbon Index (FCI). The FCI is expressed in units of carbons, and is a measure of the number of carbons in an isoparaffin that are located at least 5 carbons from a terminal carbon and 4 carbons way from a side chain. Counting the terminal methyl or branch carbon as "one" the carbons in the FCI are the fifth or greater carbons from either a straight chain terminal methyl or from a branch methane carbon. These carbons appear between 29.9 ppm and 29.6 ppm in the carbon-13 spectrum. They are measured as follows:

a. calculate the average carbon number of the molecules in the sample which is accomplished with sufficient accuracy for lubricating oil materials by simply dividing the molecular weight of the sample oil by 14 (the formula weight of $CH_2$);
b. divide the total carbon-13 integral area (chart divisions or area counts) by the average carbon number from step a. to obtain the integral area per carbon in the sample;
c. measure the area between 29.9 ppm and 29.6 ppm in the sample; and
d. divide by the integral area per carbon from step b. to obtain FCI.

Branching measurements can be performed using any Fourier Transform NMR spectrometer. Preferably, the measurements are performed using a spectrometer having a magnet of 7.0 T or greater. In all cases, after verification by Mass Spectrometry, UV or an NMR survey that aromatic carbons were absent, the spectral width was limited to the saturated carbon region, about 0-80 ppm vs. TMS (tetramethylsilane). Solutions of 15-25 percent by weight in chloroform-dl were excited by 45 degrees pulses followed by a 0.8 sec acquisition time. In order to minimize non-uniform intensity data, the proton decoupler was gated off during a 10 sec delay prior to the excitation pulse and on during acquisition. Total experiment times ranged from 11-80 minutes. The DEPT and APT sequences were carried out according to literature descriptions with minor deviations described in the Varian or Bruker operating manuals.

DEPT is Distortionless Enhancement by Polarization Transfer. DEPT does not show quaternaries. The DEPT 45 sequence gives a signal for all carbons bonded to protons. DEPT 90 shows CH carbons only. DEPT 135 shows CH and $CH_3$ up and $CH_2$ 180 degrees out of phase (down). APT is Attached Proton Test. It allows all carbons to be seen, but if CH and $CH_3$ are up, then quaternaries and $CH_2$ are down. The sequences are useful in that every branch methyl should have a corresponding CH. And the methyls are clearly identified by chemical shift and phase. The branching properties of each sample are determined by C-13 NMR using the assumption in the calculations that the entire sample is isoparaffinic. Corrections are not made for n-paraffins or cycloparaffins, which may be present in the oil samples in varying amounts. The cycloparaffins content is measured using Field Ionization Mass Spectroscopy (FIMS).

GTL base stocks and base stocks derived from synthesized hydrocarbons, for example, isodewaxed waxy synthesized hydrocarbon, e.g., Fischer-Tropsch waxy hydrocarbon base stocks are of low or zero sulfur and phosphorus content. There is a movement among original equipment manufacturers and oil formulators to produce formulated oils of ever increasingly reduced sulfur, sulfated ash and phosphorus content to meet ever increasingly restrictive environmental regulations. Such oils, known as low SAP oils, would rely on the use of base stocks which themselves, inherently, are of low or zero initial sulfur and phosphorus content. Such base stocks when used as base oils can be formulated with the catalytic antioxidant additive disclosed herein replacing or used part of the heretofore additive such as ZDDP (zinc dialkyldithio-phosphate) previously employed in stoichimetric or super stoichiometric amounts. Even if the remaining additive or additives included in the formulation contain sulfur and/or phosphorus the resulting formulated oils will be lower or low SAP.

As indicated, the base oil of the compositions of the invention may contain from 0 wt % up to about 95 wt % of a Group IV base stock, i.e., a polyalphaolefin or PAO. The preferred PAOs are those prepared from $C_8$ to $C_{12}$ mono olefins.

The compositions of the invention also include a pour point depressant consisting of a polyol ester represented by Formula I

I

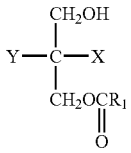

wherein x=OH or $CH_2OH$; y=H, $CH_3$, $CH_3CH_2$, or $CH_2OH$; and $R_1$ is an aliphatic hydrocarbyl group having from about 16 to about 30 carbon atoms.

The polyol esters typically are made by the esterification of a polyol such as glycerol, trimethylolpropane and 1,1,1-tris (hydroxymethyl) ethane with a fatty acid. Examples of acids include octanoic, nonenoic, decanoic, dodecanoic, undecanoic, isotridecanoic, lauric, myristic, palmitic, stearic, isostearic, arachidic, oleic, linoleic and linolenic acids.

In a particularly preferred ester of Formula I, y is H, x is OH and $R_1$ is an aliphatic group of 17 carbon atoms.

The amount of polyol ester useful in the invention is in the range of from about 0.05 wt % to about 5 wt % and preferably from about 0.3 wt % to about 0.7 wt % based on the total weight of the lubricating composition.

The compositions of the invention may include one or more lubricant additives, such as, dispersants, detergents, antioxidants, antiwear agents, viscosity index improvers, friction modifiers and defoamants.

Dispersants useful in this invention are borated and non-borated nitrogen-containing compounds that are oil soluble salts, amides, imides and esters made from high molecular weight mono and di-carboxylic acids and various amines. Preferred dispersants are the reaction product of acid anhydrides of polyolefins having an average molecular weight in the range from about 800 to about 3000, such as isobutenyl succinic anhydride with an alkoxyl or alkylene polyamine, such as tetraethylenepentamine. The borated dispersants contain boron in an amount from about 0.5 to 5.0 wt % based on dispersants. Dispersants, borated and/or non-borated or mixture thereof, are used generally in amounts from about 0.5 to about 10 wt % based on the total weight of the lubricating oil composition.

Detergents useful in the formulations include the normal, basic or overbased metal, that is calcium, magnesium and the like, salts of petroleum naphthenic acids, petroleum sulfonic acids, alkyl benzene sulfonic acids, alkyl phenols, alkylene bis-phenols, oil soluble fatty acids. The preferred detergents are the normal or overbased calcium or magnesium salicylates, phenates and/or mixtures thereof. Detergents are used generally in amounts from about 0.5 to about 6 wt % based on the total weight of the lubricating oil composition.

Examples of suitable antioxidants are hindered phenols, such as 2,6-di-tert-butylphenol, 4,4'-methylene bis(2,6-di-tert-butylphenol) 2,6-di-tert-butyl-p-cresol and the like, amine antioxidants such as alkylated naphthylamines, alkylated diphenylamines and the like and mixtures thereof. Antioxidants are used generally in amounts from about 0.01 to about 5 wt % based on the total weight of the lubricating oil composition.

Anti-wear agents generally are oil-soluble zinc dihydrocarbyldithio-phosphates having at least a total of 5 carbon atoms, the alkyl group being preferably $C_2$-$C_8$ that is primary, secondary, branched or linear. There are typically present in amounts of from about 0.01 to 5 wt %, preferably 0.4 to 1.5 wt % based on total weight of the lubricating oil composition.

Suitable conventional viscosity index (VI) improvers are the olefin polymers such as polybutene, ethylene-propylene copolymers, hydrogenated polymers and copolymers and terpolymers of styrene with isoprene and/or butadiene, A-B block copolymer such as those made by polymerization of dienes such as butadiene and/or isoprene with vinyl aromatics such as styrene known as Shell V is (star polymers), polymers of alkyl acrylates or alkyl methacrylates, copolymers of alkylmethacrylates with N-vinyl pyrrolidone or dimethylaminoalkyl methacrylate, post grafted polymers of ethylene-propylene with an active monomer such as maleic anhydride which may be further reacted with an alcohol or an alkylene polyamine, styrene-maleic anhydride polymers post-reacted with alcohols and amines and the like. These additives are used in amounts from about 1.5 to about 15 wt % based on total weight of the lubricating oil composition. The amounts also depend on the desired viscosity specifications.

Friction modifiers useful in this invention comprise molybdenum dithiocarbamates, molybdenum amine complexes and molybdenum dithiophosphates. Examples of molybdenum dithiocarbamates include $C_6$-$C_{18}$ dialkyl or diaryldithiocarbamates, or alkylaryldithiocarbamates such as dibutyl, diamyl, diamyl-di-(2-ethylhexyl), dilauryl, dioleyl and dicyclohexyl dithiocarbamate. The amount of molybdenum dithiocarbamate(s) present in the oil, ranges from about 0.05 to about 1 wt % based on total weight of lubricating oil composition. The molybdenum content can range from about 20 to about 500 ppm, most preferably from about 50 to about 120 ppm.

Defoamants, typically silicone compounds such as polydimethyl-siloxane polymers are commercially available and may be used in conventional minor amounts along with other additives such as demulsifiers; usually the amount of these additives combined is less than 1 wt % and often less than 0.2 wt % based on total weight of lubricating composition.

EXAMPLES

The invention is further illustrated by the following examples in which the low temperature properties of various lubrication compositions were determined and given in the tables herein. In the tables, the pour point is that measured by ASTM D 97, the MRV or Mini-Rotary Viscosity is that measured by the ASTM D 4684 Low Temperature Pumpability Test. The Brookfield Viscosity was determined by ASTM D 2983 and the cold-cranking simulator (CCS) apparent viscosity was measured by ASTM D 5293.

Example 1

In this example a series of lubricating compositions was prepared using one of three different polyolester additives and either a GTL base stock having a kinematic viscosity (Kv) of 3.6 $mm^2/s$ at 100° C. and a VI of 138° C. or a GTL base stock having a Kv of 60 $mm^2/s$ at 100° C. and a VI of 157° C. These two GTO base stocks are of the Group III type. The polyolester additives were:

Additive 1. A mixture of glycerol monooleate, dioleate, trioleate, glycerol monopalmitate, dipalmitate, tripalmitate, and glycerol monomyristate, dimyristate and trimyristate. The composition contained about 45 to 50% of the monoesters, 20 to 22% diesters and 30 to 33% of the triesters.

Additive 2. Glycerol monostearate (compound of Formula I, in which $R_1$ is a $C_{17}$ hydrocarbyl group).

Additive 3. Ditridecyl adipate.

The results in Table 1 show that Additive 2 (glycerol monostearate) gave significant pour point reduction in the GTL 3.6 base oil.

TABLE 1

| | Wt % | Wt % | Wt % | Wt % | Wt % | Wt % |
|---|---|---|---|---|---|---|
| Base Oil (GTL 3.6) | 100.0 | 99.4 | 99.4 | 99.4 | 0 | 0 |
| Base Oil (GTL 6.0) | 0 | 0 | 0 | 0 | 100.0 | 95.0 |
| Additive 1 | 0 | 0.6 | 0 | 0 | 0 | 0 |
| Additive 2 | 0 | 0 | 0.6 | 0 | 0 | 0 |
| Additive 3 | 0 | 0 | 0 | 0.6 | 0 | 5.0 |
| Properties | | | | | | |
| Pour Point, ° C. | −27 | −24 | −45 | −30 | −21 | −24 |
| Pour Point Reduction, ° C. | 0 | +3 | −18 | −3 | 0 | −3 |

Example 2

In this example, several lubricating compositions were prepared with a polyol ester of formula I. The lubricating compositions contained different types of base oils, namely:

GTL 3.6, which is the same GTL base stock as used in example 1, having a Kv of 3.6 $mm^2/s$ at 100° C. and a VI of 138;

GTL 6, which is the same GTL base stock as used in example 1, having a Kv of 60 $mm^2/s$ at 100° C. and a VI of 157;

SN 600, a Group II mineral oil base stock, having a VI of 96;

Group III-A4, which is a Group III mineral base stock, having a VI of 129;

Group III-A6 which is a Group III mineral base stock, having a VI of 142;

Group III-B6 which is a Group III mineral base stock, having a VI of 144;

PAO 6, which is a polyalphaolefin Group IV base stock having a VI of 137.

This Example shows that the polyol ester of this invention is effective to reduce the pour point of Group III base stocks and is most effective in isodewaxed Fischer-Tropsch wax-derived Group III base stocks (GTL). The polyol ester of this invention is however not effective in reducing the pour point of a Group II mineral oil base stock such as SN 600.

TABLE 2

| | GTL 3.6 | GTL 6 | SN 600 | Group III-A 4 | Group III-A 6 | Group III-B 6 | PAO 6 |
|---|---|---|---|---|---|---|---|
| Base Oil | | | | | | | |
| KV @ 100° C., $mm^2/s$ | 3.66 | 6.05 | 11.95 | 4.06 | 6.59 | 6.50 | 5.79 |
| Pour Point, ° C. | −27 | −18 | −12 | −21 | −21 | −12 | <−60 |
| +0.6 wt % Glycerol Monostearate | | | | | | | |
| Pour Point, ° C. | −45 | −30 | −9 | −21 | −27 | −18 | <−57 |
| Pour Point Reduction, ° C. | −18 | −12 | +3 | 0 | −6 | −6 | 0 |

Example 3

This Example shows the effect of increasing the treat rate of a polyol ester of this invention on the pour point quality. The results also show that the Low Temperature Pumpability (MRV) quality and the Brookfield viscosity is also improved at low treat rate.

TABLE 3

| | Wt % | Wt % | Wt % | Wt % |
|---|---|---|---|---|
| GTL 6 Base Oil | 100.0 | 99.70 | 99.40 | 99.10 |
| Glycerol Monostearate | 0 | 0.30 | 0.60 | 0.90 |
| Properties | | | | |
| Pour Point, ° C. | −18 | −27 | −30 | −27 |
| MRV @ −30° C., cP | 22703 | 7186 | 7316 | 7805 |
| Shear Stress, Pa | <70 | <35 | <35 | <35 |
| CCS @ −35° C., cP | 4210 | 4090 | 4110 | 4140 |
| Brookfield Viscosity @ −20° C., cP | 4680 | 2020 | 1400 | 1630 |

Example 4

In this Example, a 0W-30 engine oil lubricant was prepared with either a Fischer-Tropsch wax-derived Group III base stock (Fluid 1) or a PAO (Group IV base stock) of similar viscosity (Fluid 2) and a polyolester of Formula I. The results show that the low temperature properties of Fluid 1 were improved to about the same quality to that PAO lubricant (Fluid 2). This Example also shows that the polyol ester of this invention is effective in a fully formulated lubricating composition. The Example also shows that the pour point and MRV viscosity of the finished lubricant not containing the polyol ester of this invention (Fluid 3) can be further reduced from −42° C. to −54° C. by addition of 0.55 wt % of polyol ester.

TABLE 4

| | Fluid 1 wt % | Fluid 2 wt % | Fluid 3 wt % |
|---|---|---|---|
| Base Oil | | | |
| PAO 4 | 0 | 100.0 | 0 |
| GTL 3.6 | 100.0 | 0 | 100.0 |
| Properties | | | |
| Pour Point, ° C. | −27 | <−54 | −27 |
| Components | | | |
| PAO 4 | 0 | 70.39 | 0 |
| GTL 3.6 | 70.39 | 0 | 70.39 |
| Additives | 29.06 | 29.06 | 29.61 |
| Glycerol Monoester | 0.55 | 0.55 | 0 |
| Properties | | | |
| Viscosity @ 40° C., $mm^2/s$ | 50.36 | 60.79 | 50.48 |
| Viscosity @ 100° C., $mm^2/s$ | 10.15 | 11.1 | 10.18 |
| VI | 195 | 178 | 195 |
| CCS @ −35° C., cP | 3140 | 3940 | 3010 |
| MRV @ −40° C., cP | 12206 | 14364 | 16860 |
| Pour Point, ° C. | −54 | <−51 | −42 |

What is claimed is:

1. A method for reducing the pour point of a base oil consisting essentially of about 100 wt % of a GTL base oil by adding to the base oil from about 0.05 wt % to about 5 wt % of a pour point depressant consisting of a polyol ester represented by Formula I

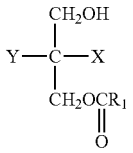

wherein x=OH or $CH_2OH$; y=H, $CH_3$, $CH_3CH_2$, or $CH_2OH$; and $R_1$ is an aliphatic hydrocarbyl group having from about 16 to about 30 carbon atoms, whereby the pour point of said base oil is reduced by at least 9° C.

2. The method of claim 1 wherein the GTI, base oil consists essentially of 100 wt % of a hydroisomerizcd or isodewaxed Fischer-Tropsch wax.

3. The method of claim 1 wherein the pour point depressant of Formula I, y is H, x is OH and $R_1$, is an aliphatic group of 17 carbon atoms and where it is incorporated in an amount ranging from about 0.30 wt % to about 0.90 wt % based on the total amount of the base oil whereby the your point of said base oil is reduced by at least 12° C.

* * * * *